United States Patent [19]

Hammill

[11] Patent Number: 4,500,152

[45] Date of Patent: Feb. 19, 1985

[54] UNIVERSAL OUTLET

[75] Inventor: S. Scott Hammill, Mount Laurel, N.J.

[73] Assignee: SL Industries, Inc., Marlton, N.J.

[21] Appl. No.: 430,608

[22] Filed: Sep. 30, 1982

Related U.S. Application Data

[63] Continuation-in-part of Ser. No. 190,050, Sep. 23, 1980, Pat. No. 4,364,623.

[51] Int. Cl.[3] ..... H01R 11/00

[52] U.S. Cl. ..... 339/61 M; 339/95 R; 339/192 R; 339/206 R

[58] Field of Search ..... 339/59 R, 59 M, 61 R, 339/61 M, 95 R, 192 R, 191 R, 191 M, 128, 217 R, 217 PS, 21 R, 206 P, 206 R

[56] References Cited

U.S. PATENT DOCUMENTS

| | | | |
|---|---|---|---|
| D. 208,551 | 9/1967 | Geis, Jr. | D13/24 |
| 2,062,752 | 12/1936 | Kindberg | 339/21 R |
| 2,108,031 | 2/1938 | Acuff | 339/21 R |
| 2,234,745 | 3/1941 | Von Rarrel | 339/21 R |
| 2,250,513 | 7/1941 | Von Gehr | 339/21 R |
| 2,464,964 | 3/1949 | Charap | 339/21 R |
| 2,743,423 | 4/1956 | Parks | 339/21 R |
| 2,781,497 | 2/1957 | Sheskier | 339/21 R |
| 3,044,035 | 7/1962 | Adams, Jr. | 339/21 R |
| 3,081,442 | 3/1963 | Platz | 339/95 R |
| 3,089,042 | 5/1963 | Hichey et al. | 307/147 |
| 3,116,960 | 1/1964 | Olsson | 339/128 |
| 3,253,137 | 5/1966 | Richter | 339/96 |
| 3,714,618 | 1/1973 | Appleton | 339/198 R |
| 3,715,457 | 2/1973 | Teagno et al. | 174/88 R |
| 3,778,748 | 12/1973 | Holman | 339/64 M |
| 4,113,334 | 9/1978 | Instone | 339/22 R |
| 4,364,623 | 12/1982 | Hammill | 339/126 RS |

FOREIGN PATENT DOCUMENTS

| | | |
|---|---|---|
| 1121755 | 5/1956 | France . |
| 1066240 | 4/1967 | United Kingdom . |
| 2033678 | 5/1980 | United Kingdom . |
| 2069249 | 8/1981 | United Kingdom . |

OTHER PUBLICATIONS

IBM Technical Disclosure Bulletin vol. 10, No. 10, pp. 1521, 1522, R. T. Evans "Constant Pressure Pluggable Circuit Elements"; 1968.

*Primary Examiner*—John McQuade
*Assistant Examiner*—Gary F. Paumen
*Attorney, Agent, or Firm*—Cushman, Darby & Cushman

[57] ABSTRACT

An electrical outlet receptacle receives conductor wires without crimping. A receptacle body of electrical insulating material has a face with a number of cantilever portions and projections extending from one side of the face. Cooperating cam surfaces are formed on the cantilever portions and projections, as well as locking surfaces, to receive conductor wire bare portions. The conductor wire bare portions are mounted so that they are directly tangentially engaged by an electrical plug prong when a prong is inserted into a prong-receiving slot in the receptacle body face.

17 Claims, 13 Drawing Figures

Fig. 1
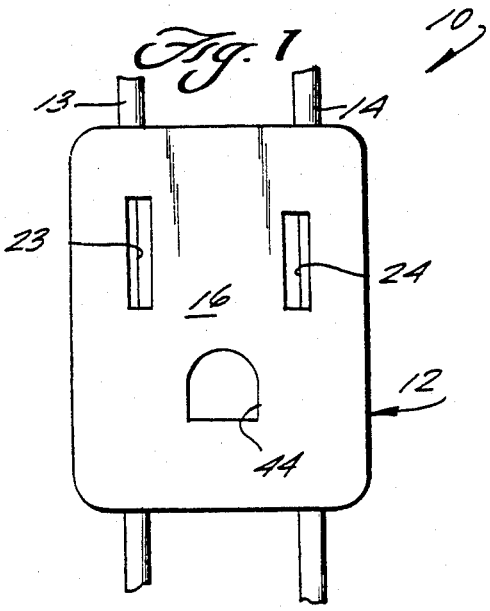
Fig. 2
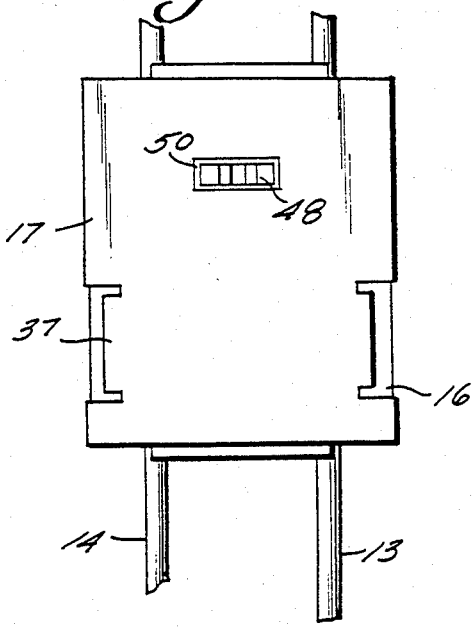
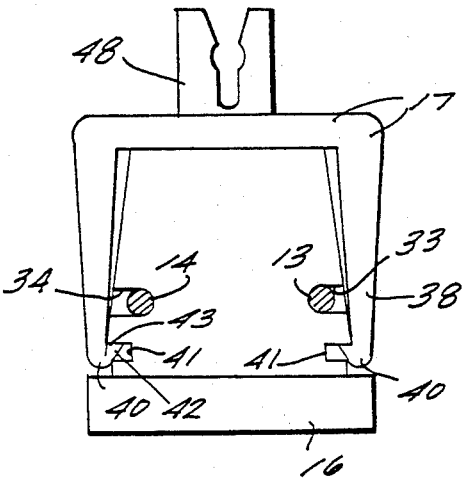
Fig. 3
Fig. 4
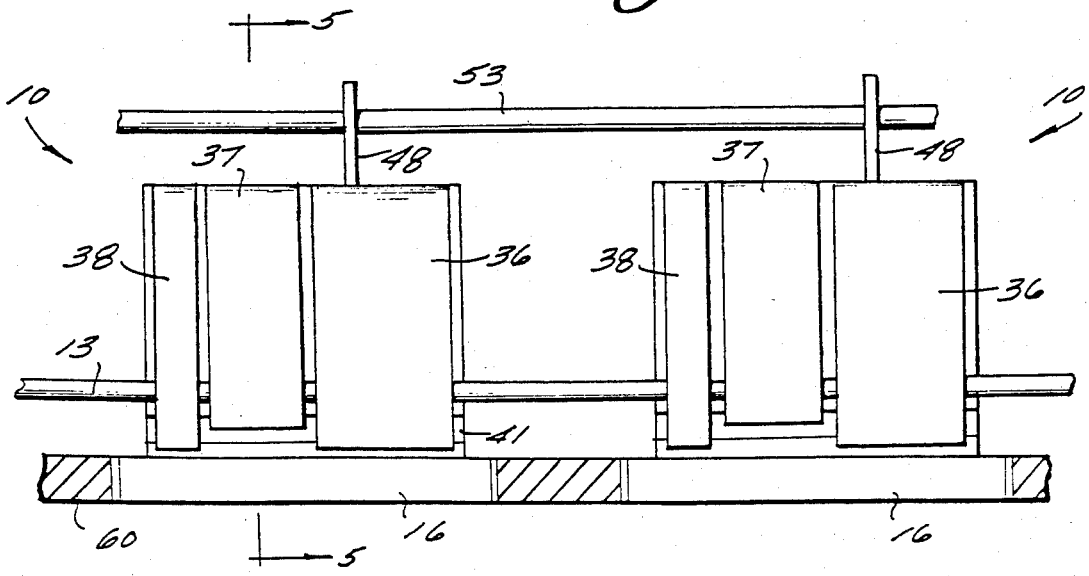

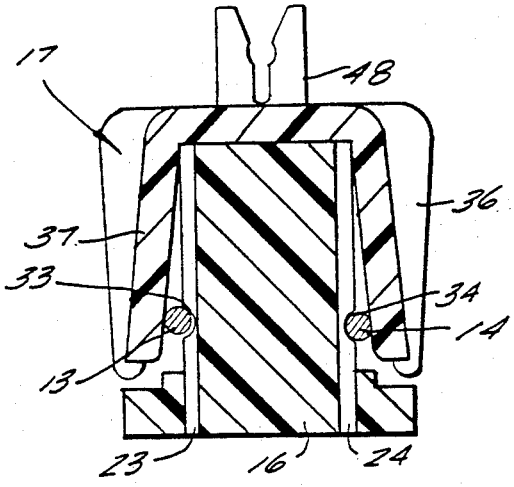
Fig. 5
Fig. 6
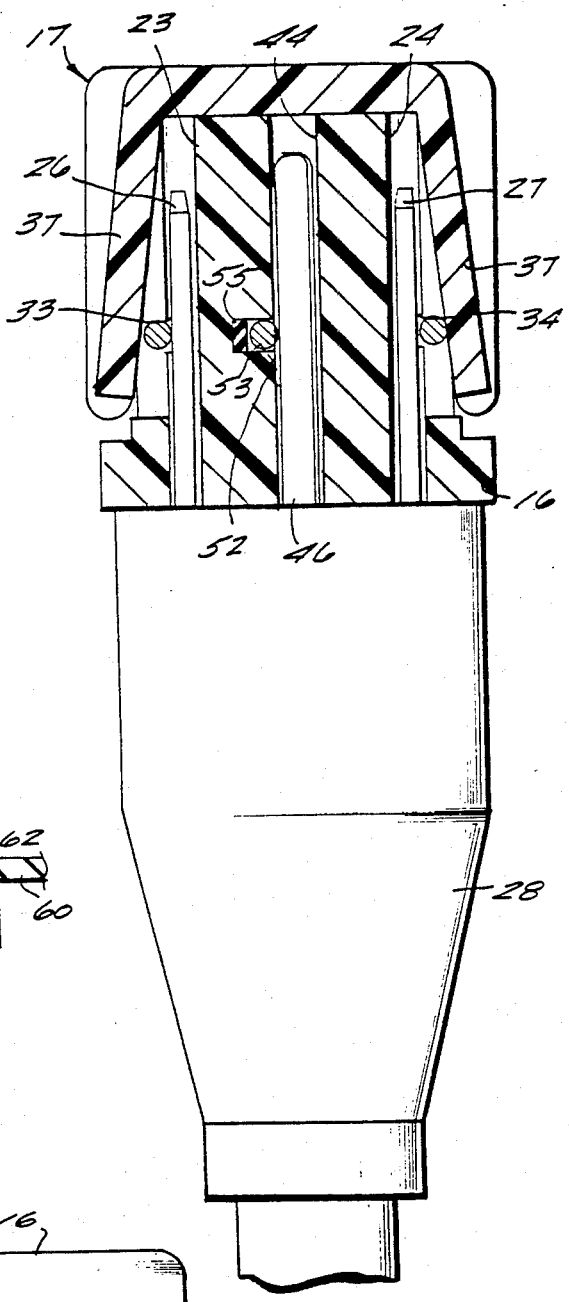
Fig. 8
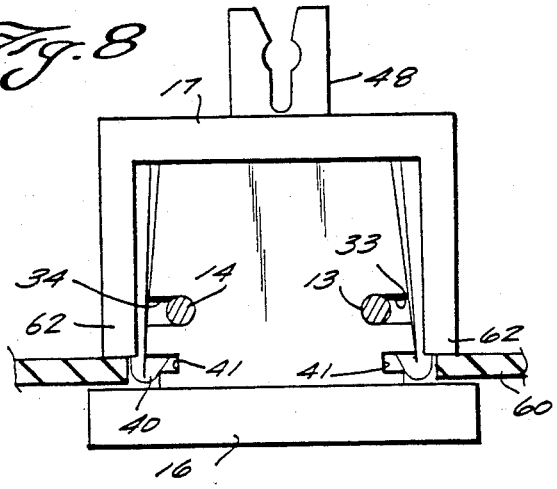
Fig. 7
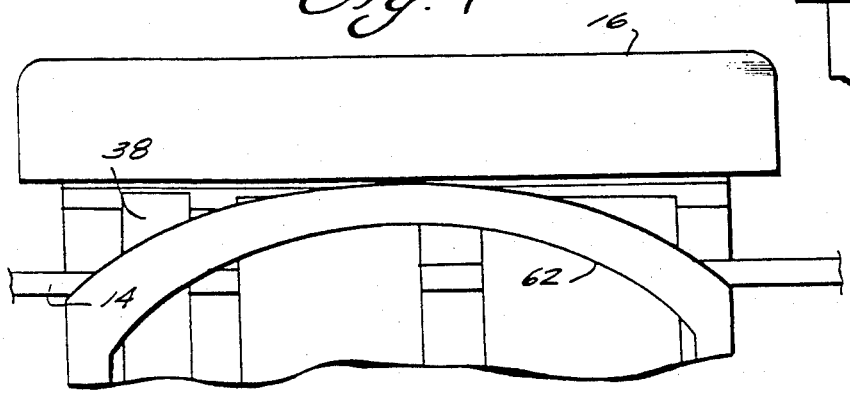

UNIVERSAL OUTLET

CROSS-REFERENCE TO RELATED APPLICATION

This application is a continuation-in-part of application Ser. No. 190,050 filed Sept. 23, 1980, now U.S. Pat. No. 4,364,623.

BACKGROUND AND SUMMARY OF THE INVENTION

Conventional electrical receptacles include receptacle bodies having electrical plug prong-receiving slots formed therein, with a conductor assembly formed in each slot. The conductor assembly, such as exemplified by U.S. Pat. Nos. 2,743,423 and 3,081,442, usually comprises a conductor wire with a spring contact engaging the conductor wire and disposed in the slot for making frictional engagement with a prong inserted into the slot. Such constructions perform their intended functions well, but are relatively expensive to make and to install in junction boxes, multiple electrical outlet strips, or the like. Because of such disadvantages, U.S. Pat. No. 4,113,334 (the disclosure of which is hereby incorporated by reference herein) has proposed the formation of the terminals from the conductors in such a way that a number of receptacles may be electrically interconnected easily together by soldering and/or crimping of the contact terminals in engagement with the current carrying wires. While such an arrangement is eminently practical it too is more expensive and time consuming than desired.

According to the present invention, an electrical receptacle is provided that eliminates all the drawbacks inherent in prior arrangements. According to the present invention an electrical receptacle is provided that has a minimum number of components and can be assembled in the simplest manner possible. The only electrical plug prong-receiving conductive components comprises the conductor wires themselves, and the wires are arranged in such a manner that no soldering or crimping is necessary to effect connection thereof. Rather, either the receptacle body component parts are merely snapped together to retain the wires in appropriate position; or the wires are directly snapped into the body component parts themselves. Any number of receptacles can be connected in this manner with the same conductor wires. Such an arrangement provides the epitomy of simplicity, minimized costs, and minimized labor in assembling components.

According to one aspect of the present invention, an electrical receptacle comprises a receptacle body of electrical insulating material, and includes a face. Means are provided defining first, second, and third spaced, parallel, elongated prong-received slots in the receptacle body face. First, second, and third conductor wires, each having a bare, uninsulated portion thereof, and each being substantially longer than any dimensions of the body are received by the body. A plurality of elongated flexible cantilever portions of said body are provided, each having an end fixed to the body face, and each having a free end spaced from the body face, the cantilever portions elongated in the same dimension of elongation as the prong-receiving slots. Each cantilever portion has a cam surface formed on the free end thereof and a locking surface extending generally perpendicular (but preferably slightly arcuate) to the dimension of elongation of the cantilever portion with which it is associated and immediately adjacent the cam surface. The body also includes a plurality of relatively rigid projections extending from the body face in the same dimension of elongation as the cantilever portions. The projections, some of which also have cam surfaces cooperating with the cantilever portion cam surfaces and abutment surfaces generally parallel to the respective cantilever portion locking surfaces but spaced therefrom (being located nearer the body face), cooperate with the cantilever portions to provide means for receiving the conductor wire bare portions. Such means also mount the conductor wire bare portions so that each extends substantially perpendicular to and intersects a respective prong-receiving slot and will be directly tangentially engaged by an electrical plug prong when such a prong is inserted into the respective prong-receiving slot in the receptacle face.

It is the primary object of the present invention to provide a simple, inexpensive, electrical receptacle having a minimum number of parts and being electrically connectable without soldering or crimping of any terminal components or the like. This and other objects of the invention will become clear from an inspection of the detailed description of the invention and from the appended claims.

BRIEF DESCRIPTION OF THE DRAWINGS

FIG. 1 is a top plan view of an exemplary electrical receptacle according to the present invention;

FIG. 2 is a bottom plan view of the receptacle of FIG. 1;

FIG. 3 is an end view of the receptacle of FIG. 1;

FIG. 4 is a side view of a plurality of receptacles of FIG. 1 electrically interconnected together in a multiple electrical outlet strip or the like;

FIG. 5 is a cross-sectional view taken along lines 5—5 of FIG. 4;

FIG. 6 is a cross-sectional view of a modified form of the receptacle of FIG. 5 shown in operative relationship with an electrical plug;

FIG. 7 is a side view of a receptacle like that of FIGS. 1–3 with integral spring mounting members;

FIG. 8 is an end view of the FIG. 7 modification shown in mounting relationship with a mounting surface;

DETAILED DESCRIPTION OF THE DRAWINGS

Figure 9:
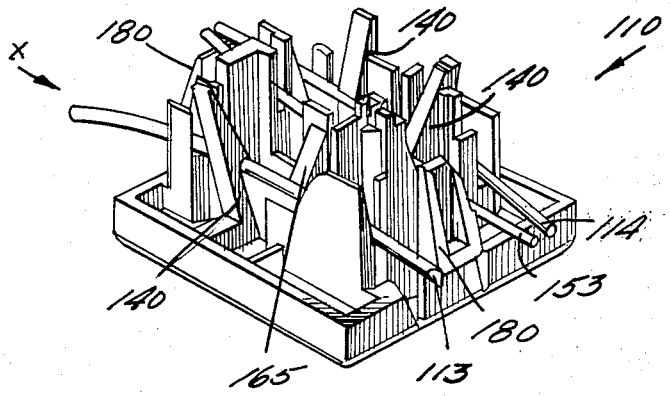
FIG. 9 is a bottom perspective view of another exemplary embodiment of an electrical receptacle according to the present invention, shown receiving three conductor wire bare portions.

An electrical receptacle according to the present invention is shown generally at 10 in FIGS. 1–8 and at 110 in FIGS. 9–13 of the drawings. The three major components of the receptacle include a receptacle body 12 of electrically insulating material, a first conductor wire 13, and a second conductor wire 14. Conventional plastics having good dielectric properties with some ability to "flex" are suitable for the insulating material of body 12. For instance, Phenolic plastics, if the body 12 is formed by compression molding, are suitable, and Valox is a suitable plastic if the body 12 is formed by injection molding.

In the FIGS. 1–8 embodiment, the receptacle body 12 comprises two body parts, such as face part 16 and rear part 17. Means are provided defining first and second spaced parallel, elongated prong-receiving slots 23, 24 in the body 12, primarily in the face part 16 thereof. Means are formed in the receptacle body 12 for receiving the first and second conductor wires 13, 14 and mounting them so that they intersect the first and second prong-receiving slots 23, 24 respectively of plug 28 (see FIGS. 5 and 6 in particular) so that the bare portions thereof will be directly engaged by an electrical plug prong 26, 27 respectively (see FIG. 6) when received by a slot 23, 24 respectively. Such conductor wire receiving and mounting means includes the formation of the slots 23, 24 so that they are open on the sides of the body face part 16; means defining first and second grooves 33, 34 respectively in the sides of the body face part 16, the grooves 33, 34 receiving the first and second conductor wires 13, 14 respectively; and the receptacle body rear part 17. The grooves 33, 34 are formed so that they are substantially perpendicular to the direction of elongation of the prong-receiving slots 23, 24, as indicated in the drawings.

The receptacle body second part 17 includes a portion thereof that resiliently biases the conductor wires 13, 14 so that they intersect the prong-receiving slots 23, 24. As illustrated in the drawing, the rear part 17 may be generally U-shaped, and include first (36) second (37) and third (38) generally U-shaped subparts. The first and third subparts 36, 38 are relatively thick and therefore relatively inflexible (see and compare FIGS. 3 and 5), while the second part 37 is relatively thin and therefore relatively flexible and provides for the resilient biasing of the conductor wires 13, 14.

The face 16 and rear 17 parts of the receptacle body 12 may be held together in any convenient manner. One particularly suitable manner is to form a tongue and groove connection between the part 16, 17 so that when they are snapped together the tongues and grooves hold them together. For instance, with respect to FIG. 3, attention is directed to the tongue portions 40 formed on the arms of the U-shaped first and third subparts 36, 38, and the continuous grooves 41 formed along the sides of the face part 16 for receipt of the tongues or cantilever portions 40. The cantilever portions 40 are dimensioned and the face part 16 is sloped, so that the rear part 17 may be pushed over the face part 16 with the legs of the U-shaped first and third subparts 36, 38 being cammed outwardly until the tongues 40 fall into the grooves 41, latching the parts 16, 17 together with the second subpart 37 resiliently biasing the conductor wires 13, 14 to intersect the prong-receiving grooves 23, 24 (see FIGS. 5 and 6 in particular).

As seen in FIG. 3, the cantilever portions 40 and associated arms of the receptacle body portion are elongated in a dimension parallel to the dimension of elongation of said prong-receiving slots 23, 24. Each cantilever portion 40 include a cam surface 42 at the free end thereof, and a locking surface 43 extending generally perpendicular to the dimension of elongation of said cantilever portion 40, and adjacent said cam portion 42.

While the receptacles 10 are illustrated in the drawings with only one set of prong-receiving openings 23, 24 etc., the parts 16, 17 may be much elongated to contain 2, 3, 4 or any number of prong-receiving openings 23, 24 and associated structures. The conductors 13, 14 extend in line with the various portions of the receptacles.

The conductor wires 13, 14 are illustrated in the drawings as completely bare, however if desirable only portions thereof at the area of intersection of the grooves 33, 34 and the prong-receiving slots 23, 24 need be bare.

The electrical receptacle 10 according to the present invention also preferably includes a ground contactor. A third elongated prong-receiving slot 44 is provided in the body part 16 for a conventional ground prong 46 (see FIG. 6) of a conventional electrical plug 28 and a conductor is received by the receptacle body for contacting the electrical plug ground plug when inserted in the prong-receiving slot 44. The electrical conductor can be a conventional electrical conductor having a terminal 48, such as provided in U.S. Pat. No. 4,113,334 (the disclosure of which is hereby incorporated by reference herein), in which case an opening 50 is formed in the rear body part 17 for passage of the terminal 48 therethrough. Such an arrangement is illustrated in FIGS. 2–5. Alternatively, the ground conductor arrangement could be similar to the neutral and hot conductor wire 13, 14 arrangements described above. That is, with reference to FIG. 6, an interior passageway 52 may be provided in the body face part 16 for receipt of a grounding conductor wire 53 which intersects the ground prong-receiving slot 44. A resilient material pad 55 could be provided in the passageway 52, if desired, to bias the wire 53 into the intersecting relationship with the slot 44, as illustrated in FIG. 6.

The receptacles 10 according to the present invention ma be readily connected together in a multiple electrical outlet strip or the like. For instance, as illustrated in FIG. 4, a plurality of the receptacles 10 can be inserted so that the face part 16 of the receptacle body 12 is each received by and faces outwardly of a housing face 60 (such as the casing component illustrated in U.S. Pat. No. 4,113,334), being held therein in any suitable manner, such as shown in U.S. Pat. No. 4,113,334, or as shown in FIGS. 7 and 8. Electrical interconnection of the components is simply provided by disposing the conductor wires 13, 14 in the grooves 33, 34 formed in each of the receptacles 10, respectively, and then snapping the rear receptacle body parts 17 into interengagement with the receptacle body first parts 16 so that the resilient portion 37 of each receptacle body biases the conductors 13, 14 into intersecting relationship with the prong-receiving slots 23, 24 of that receptacle. The common ground wire 53 is merely laid in the ground terminals 48 of the receptacles 10, being snapped into place therein.

In the modification illustrated in FIGS. 7 and 8, connection of each receptacle to the housing face 60 is accomplished utilizing the spring members 62. These plastic springs 62 are molded integrally with the rear part 17 of the receptacle 10, and provide ready mounting of the receptacles 10 to face plates (mounting surfaces) 60 of varying thickness.

In the embodiment of the receptacle illustrated in FIGS. 9 through 13, a simplified construction is provided, no second body part being necessary in order to properly receive the conductor wires. The receptacle 110 comprises a body of electrical insulating material (e.g. phenolic plastics, Valox, or like thermoplastic materials) including a face 116 which has means defining first, second, and third spaced, parallel, elongated prong-receiving slots 123, 124, 144 therein. The conductor wires in this embodiment are referenced by numerals 113, 114, 153, the wire 153 preferably providing the ground.

Figure 12:
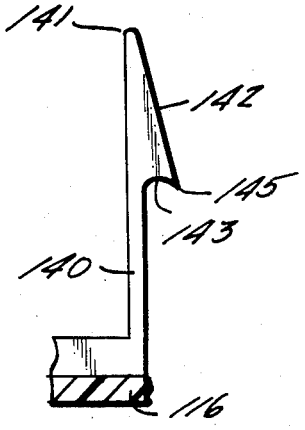
FIG. 12 is a side view of the cantilever portion of FIG. 11.
Figure 13:
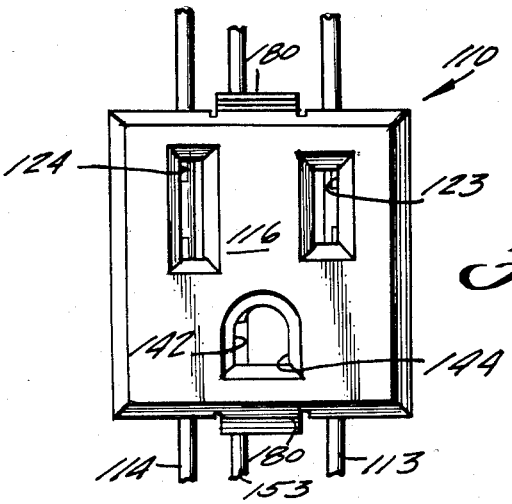
FIG. 13 is a top plan view of the receptacle of FIG. 9.

Part of the receptacle body of receptacle 110 for receiving the wires 113, 114 and 153 comprises a plurality of cantilever portions 140, preferably one associated with each wire. The cantilever portions are affixed to the face 116 (see FIGS. 9 and 12) at one end thereof, and have a free end 141 spaced from the face part 116, the cantilever portion 140 being elongated in the dimension of elongation of the slots 123, 124, 144. A cam surface 142 is formed on the free end 141 of each cantilever portion 140. A locking surface 143 is provided extending generally perpendicular to the dimension of elongation of each of the cantilever portions 140, and immediately adjacent the cam surface 142. While the locking surface 143 may be flat, as illustrated in FIG. 12 it is preferably slightly arcuate to correspond generally to the arcuate configuration of a wire (e.g. 113) to be held thereby.

Cooperating with the cantilever portions 140 to receive the wires 113, 114, and 153 are a plurality of relatively rigid projections projecting from the face part 116 in the same dimension of elongation as the cantilever portions 140. One typical type of such projections is illustrated generally by reference numeral 165 in FIGS. 9 and 11. This type of projection has a cam surface 167 cooperating with the cam surface 142 of an associated cantilever portion 140, and also includes a wire abutting surface 169 generally parallel to the locking surface 143 and spaced therefrom in the dimension of elongation of the cantilever portion 140, being nearer the face 116 as clearly illustrated in FIG. 11. Since the projection 165 is relatively rigid, when a wire—e.g. wire 113 in FIG. 11—is moved in the direction Z in FIG. 11 into contact with the cam surface 142, it causes the cantilever portion 140 to flex outwardly—as illustrated in dotted line in FIG. 11—the wire 113 abutting both cam surfaces 142 and 167 as it is pushed in direction Z. When the wire 113 passes the end 145 of the cam surface 142, it is received by the locking surface 143, and at the same time abuts the surface 169 at the bottom thereof, and also abuts a straight portion 170 adjacent the surface 169 (see FIG. 11).

Figure 10:
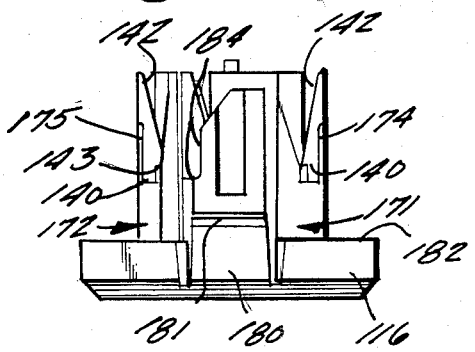
FIG. 10 is an end view of the receptacle of FIG. 9 looking in the direction of arrow X of FIG. 9.
Figure 11:
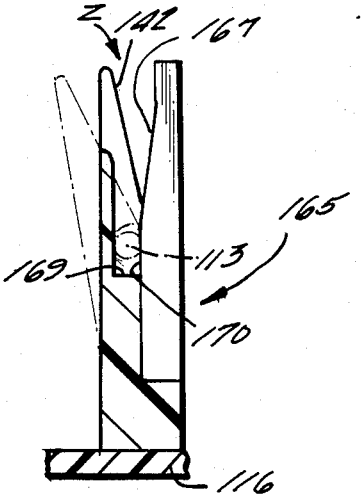
FIG. 11 is a detail view partly in cross-section and partly in elevation showing cooperation between a cantilever portion and a relatively rigid projection of the receptacle of FIGS. 9 and 10, and in dotted line showing the cantilever portion flexed to receive a conductor wire.

Preferably projections, such as projections 165, are provided on either side of each cantilever portion 140 along the dimension of elongation of a wire (e.g. 113, 114, 153). FIG. 10 shows somewhat modified forms of projections cooperating with cantilever portions 140, such projections being shown generally by reference numerals 171 and 172. The projection 171 is disposed at the end of a receptacle, and is generally similar to the projection 165 only it also contains a retaining portion 174 to minimize sideways movement or bending of a wire received thereby at that point. Projection 172 also includes a surface portion 175, but otherwise is substantially the same as a projection 165.

The receptacle 110 also includes a pair of flexible mounting tabs 180 (see FIGS. 9, 10, and 13) at opposite ends thereof. The mounting tabs 180 are integral with the face 116, and can flex so as to receive a mounting surface between ridged portions 181 and the bottom surface 182 of face 116 (see FIG. 10). The mounting tabs 180 are per se conventional, except that they are provided with surface means for receiving one of the wires—i.e. wire 153. The surface means may take the form of surfaces 184 in FIG. 10, those surfaces cooperating with a cantilever portion 140, and projections 165, etc., to provide for secure mounting of the wire 153.

Any number of the receptacles 110 can be assembled into a multiple electrical outlet strip or the like, as disclosed in U.S. Pat. No. 4,113,334.

It will thus be seen that according to the present invention an electrical receptacle has been provided which is simple, inexpensive, and readily connectable with other receptacles, and effective. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. An electrical receptacle comprising: a receptacle body of relatively inflexible electrical insulating material; means defining first and second spaced, parallel, elongated prong-receiving slots in said receptacle body; first and second conductor wires, each having a bare, uninsulated portion thereof, and each being substantially longer than any dimension of said body; means formed in said receptacle body for receiving said first conductor wire bare portion so that it extends substantially perpendicular to the direction of elongation of said first prong-receiving slot and intersects said slot, and for mounting said second conductor wire bare portion so that it extends substantially perpendicular to said second prong-receiving slot and intersects said slot, and for mounting said first and second wire conductor bare portions so that they will be directly tangentially engaged by an electrical plug prong when a said prong is inserted into said respective first and second prong-receiving slots; resilient biasing means for resiliently biasing said first and second conductor wire bare portions into intersecting relationship with said first and second prong-receiving slots, said resilient biasing means comprising portions of said receptacle body that are thinned so that they are relatively flexible, said thinned portions extending only a small part of the dimension of said housing parallel to the dimension of elongation of said first and second conductor wire; and said receptacle body thinned portions comprising flexible cantilever portions each having a free end and a fixed end and elongated in a dimension parallel to the dimension of elongation of said prong-receiving slots, each of said cantilever portions including a cam portion on the free end thereof and a locking surface extending generally perpendicular to the dimension of elongation of said cantilever portion, and immediately adjacent said cam surface.

2. An electrical receptacle as recited in claim 1 further comprising means defining a third elongated prong-receiving slot in said receptacle body for receipt of an electrical plug ground prong; a third conductor wire, having a bare, uninsulated portion thereof, and being substantially longer than any dimension of said body; means formed in said receptacle body for receiving said third conductor wire bare portion and mounting it so that it extends substantially perpendicular to said third prong-receiving slot in said receptacle body and intersects said slot at an intermediate portion of said slot; and resilient biasing means for resiliently biasing said third conductor wire bare portion into intersecting relationship with said third prong-receiving slot.

3. An electrical receptacle as recited in claim 1 wherein said receptacle body comprises a face in which said elongated prong-receiving slots are formed, said face disposed in a plane perpendicular to the direction of elongation of said prong-receiving slots; and each of said elongated cantilever portions operatively connected at said fixed end thereof to said receptacle body face and said cam portion thereof spaced from said face, said cantilever portion elongated in the dimension of elongation of said prong-receiving slots.

4. An electrical receptacle as recited in claim 3 wherein said means for receiving said conductor wire bare portions comprise said cantilever portions and relatively rigid projecting portions projecting in the same direction from said face as said cantilever portions, each projecting portion comprises a cam surface complimentary to a corresponding cantilever portion cam surface, and an abutment surface generally perpendicular to the direction of elongation of a cooperating cantilever portion, and located nearer said face than said locking surface of said cooperating cantilever portion.

5. An electrical receptacle comprising: a receptacle body of electrical insulating material; means defining first, second, and third spaced, parallel, elongated prong-receiving slots in said receptacle body; first, second, and third conductor wires, each having a bare, uninsulated portion thereof, and each being substantially longer than any dimensions of said body; means formed on said receptacle body for receiving said first, second, and third conductor wire bare portions and mounting said first conductor bare portion so that it extends substantially perpendicular to and intersects said first prong-receiving slot, mounting said second conductor wire bare portion so that it extends substantially perpendicular to and intersects said second prong-receiving slot, and mounting said third conductor wire bare portion so that it extends substantially perpendicular to and intersects said third prong-receiving slot, and for mounting said conductor wires so that said first, second, and third conductor wire bare portions will be directly tangentially engaged by an electrical plug prong when a said prong is inserted into said respective first, second, or third prong-receiving slots; and said receptacle body including a plurality of elongated flexible cantilever portions each having a free end and fixed end, and each having a cam surface formed on the free end thereof and a locking surface extending generally perpendicular to the dimension of elongation of said cantilever portion, and immediately adjacent said cam surface.

6. An electrical receptacle as recited in claim 5 further comprising a portion of said receptacle body comprising resilient biasing means for resiliently biasing at least said first and second conductor wire bare portions into intersecting relationship with said first and second prong-receiving slots.

7. An electrical receptacle as recited in claim 5 wherein said receptacle body comprises a face in which said elongated prong-receiving slots are formed, said face disposed in a plane perpendicular to the direction of elongation of said prong-receiving slots; said elongated cantilever portions operatively connected at said fixed end thereof to said receptacle body face with said cam surface thereof spaced from said face, said cantilever portions elongated in the dimension of elongation of said prong-receiving slots.

8. An electrical receptacle as recited in claim 7 wherein said means for receiving said conductor wire bare portions comprise said cantilever portions and relatively rigid projecting portions projecting in the same direction from said face as said cantilever portions, each projecting portion comprises a cam surface complimentary to a corresponding cantilever portion cam surface, and an abutment surface generally perpendicular to the dimension of elongation of a cooperating cantilever portion, and located nearer said face than said locking surface of said cooperating cantilever portion.

9. An electrical receptacle as recited in claim 7 wherein each cantilever portion locking surface has an arcuate configuration generally corresponding to an arcuate surface of a bare wire portion to be received thereby.

10. An electrical receptacle as recited in claim 7 wherein said base includes a pair of flexible mounting tabs at opposite ends thereof, and further comprising means defining wire-abutting surfaces on a portion of each of said mounting tabs, said wire-abutting surfaces comprising part of said means for mounting one of said conductor wires so that a bare portion thereof will be directly tangentially engaged by an electrical plug prong when a said prong is inserted into a respective prong-receiving slot.

11. An electrical receptacle as recited in claim 9 wherein a projecting portion is provided on each side of each cantilever portion in the dimension of elongation of a conductor wire received thereby.

12. An electrical receptacle as recited in claim 11 wherein said projecting portion and cantilever portion free ends remain uncovered during use.

13. An electrical receptacle comprising: a receptacle body of electrical insulating material, including a face; means defining first and second spaced, parallel, elongated prong-receiving slots in said receptacle body face; first and second conductor wires, each having a bare uninsulated portion thereof and being substantially longer than any dimension of said body; a plurality of elongated flexible cantilever portions of said receptacle body operatively fixed at one end thereof to said receptacle body face and having a free end thereof spaced from said receptacle body face, said cantilever portions elongated in the dimension of elongation of said prong-receiving slots; each cantilever portion having a cam surface formed on the free end thereof and a locking surface extending generally perpendicular to the dimension of elongation of said cantilever portion and immediately adjacent said cam surface; a plurality of relatively rigid projections of said receptacle body extending from said body face in the same dimension of elongation as said cantilever portions, said projections cooperating with said cantilever portions to provide means for receiving said first and second conductor wire bare portions and mounting said bare portions so that they extend substantially perpendicular to and intersect the respective first and second prong-receiving slots, and so that they will be directly tangentially engaged by an electrical plug prong when a said prong is inserted into a respective prong-receiving slot.

14. An electrical receptacle as recited in claim 13 wherein each cantilever portion locking surface has an arcuate configuration generally corresponding to an arcuate surface of a bare wire portion to be received thereby.

15. An electrical receptacle as recited in claim 14 wherein a said projecting of said receptacle body is provided on each side of each cantilever portion in the dimension of elongation of a conductor wire received thereby.

16. An electrical receptacle as recited in claim 15 wherein said projections and cantilever portion free ends remain uncovered during use.

17. An electrical receptacle as recited in claim 13 further comprising means defining a third prong-receiving slot; a third conductor wire; and means for receiving said third conductor wire to be engaged by an electrical plug prong inserted into said third prong-receiving slot; and wherein said base includes a pair of flexible mounting tabs at opposite ends thereof; and further comprising means defining wire-abutting surfaces on a portion of each of said mounting tabs, said wire-abutting surfaces comprising part of said means for mounting said third conductor wires so that a bare portion thereof will be directly tangentially engaged by an electrical plug prong when a said prong is inserted into a respective prong-receiving slot.

* * * * *